United States Patent [19]

Wilson

[11] 4,254,587

[45] Mar. 10, 1981

[54] PIVOTAL WORK HOLDING DEVICE FOR GRINDING GEMSTONES

[76] Inventor: Hugh R. Wilson, 10840 SW. 120th St., Miami, Fla. 33176

[21] Appl. No.: 104,679

[22] Filed: Dec. 17, 1979

[51] Int. Cl.[3] ..... B24B 9/16

[52] U.S. Cl. ..... 51/229; 51/124 R

[58] Field of Search ..... 51/229, 124 R, 234

[56] References Cited

U.S. PATENT DOCUMENTS

| | | | |
|---|---|---|---|
| 231,577 | 8/1880 | Hessels | 51/229 |
| 1,575,156 | 3/1926 | Ecaybert | 51/229 X |
| 2,368,108 | 1/1945 | Bourgeois | 51/124 |
| 2,398,628 | 4/1946 | Dykoski | 51/124 |
| 2,527,592 | 10/1950 | Spira | 51/229 |
| 3,020,680 | 2/1962 | Soderman | 51/124 R |

*Primary Examiner*—Harold D. Whitehead

[57] ABSTRACT

This invention is a work holding device that holds a stone in contact with an abrading surface for grinding of the stone.

The stone is continuously moved across the face of the abrading surface in an arcuate path to expose the stone to fresh abrading surface and to avoid grooving of the abrading surface as would occur if the stone was held in a stationary position.

A dop-holding tong is held on a platform. The platform is pivotally mounted on a base and the platform is rotated in an alternating direction by a motor driven crank-slide that provides movement to the platform and the stone bearing dop.

5 Claims, 5 Drawing Figures

PIVOTAL WORK HOLDING DEVICE FOR GRINDING GEMSTONES

FIELD OF THE INVENTION

The device is intended for use in grinding gemstones and for use for grinding industrial diamonds for the manufacture of industrial tools.

DESCRIPTION OF THE PRIOR ART

In the past, a dop has been in a tong and the tong has been placed in a stationary position so as to hold the stone bearing dop in a stationary position against the surface of an abrading lap plate. The tong was easily removed from it's position so that the stone could be readily examined and the tong was then returned to it's former position. Because of the continous and prolonged contact of the stone with the lap surface, a groove was worn in the surface of the lap which requires a frequent re-surface operation on the lap to restore the flat surface.

This simple device provides a continous arcuate movement to the stone across the face of the lap plate as the lap plate rotates and uses the entire abrasive charged surface of the lap plate while at the same time avoiding grooving of the lap plate. The novel tong holding plate allows the tong to be removed at any time and assures exact placement when the tong is returned to a grinding position.

This invention provides a novel and useful improvement in the art and the simple design and construction allows it to be cheaply manufactured and at the same time, the simple construction assures excellent wearing ability under long hard service.

SUMMARY OF THE INVENTION

It is an object of this invention to provide a new and useful work holding device that will eliminate grooving of a lap plate when grinding stones.

It is another object of this invention to provide the simple acuate movement of the stone across the rotating lap plate to distribute the wear evenly and to fully utilize the abrasive charging on the plate and therefor eliminate waste of expensive abrasive.

It is a further object of this invention to provide a new and useful device that can be manufactured and sold at low cost to the industry.

A BRIEF DESCRIPTION OF THE DRAWINGS

DESCRIPTION OF THE PREFERRED EMBODIMENT

Figure 1:
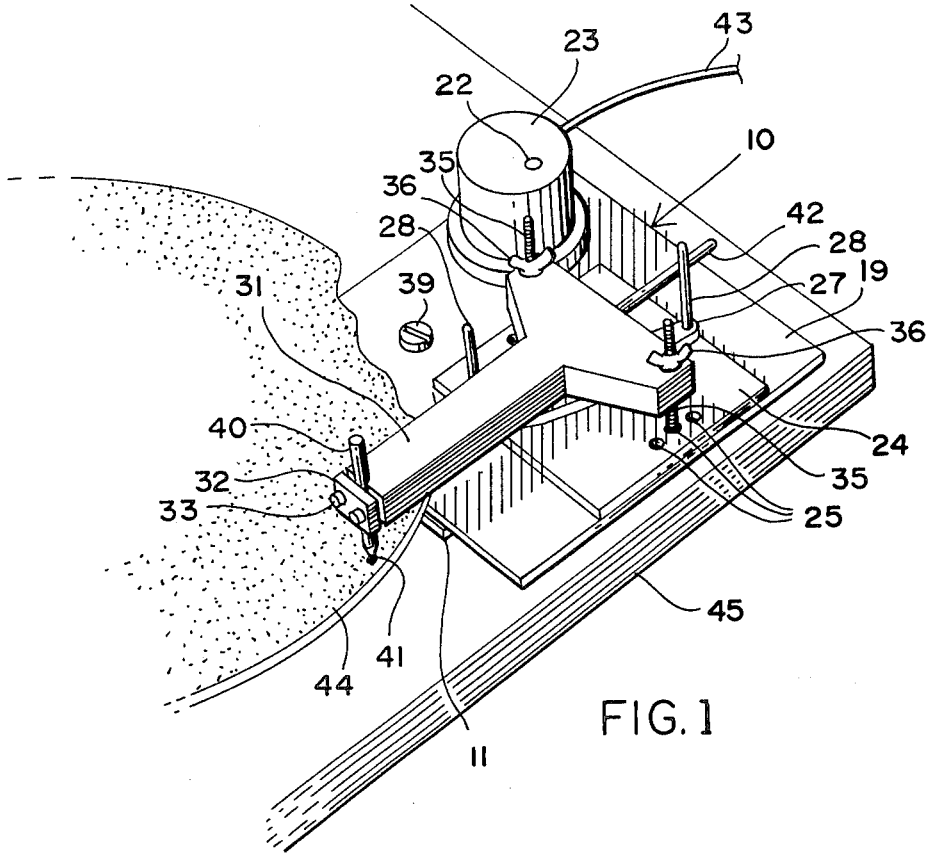
FIG. 1 shows the device in operation with the stone in contact with the lapping plate.
Figure 2:
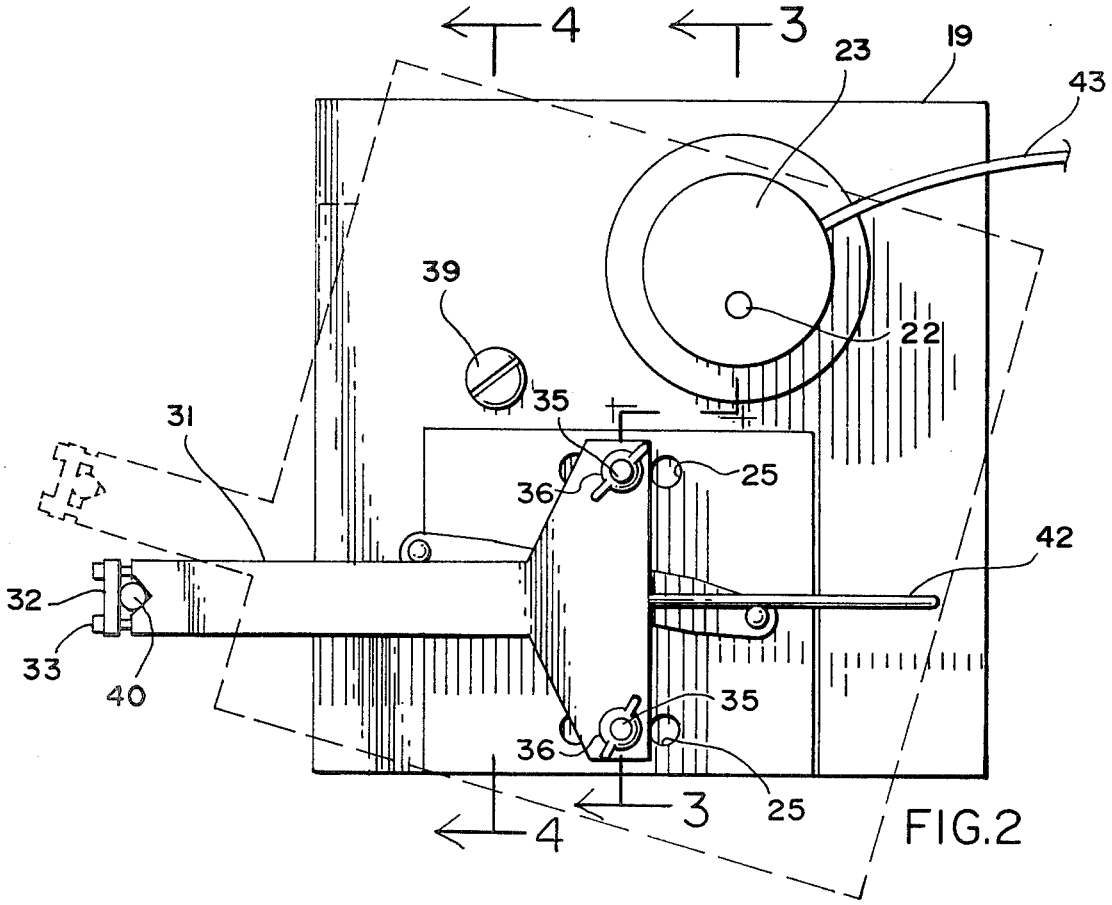
FIG. 2 is a top view of the device with the movement of the platform and dop shown in broken lines.
Figure 5:
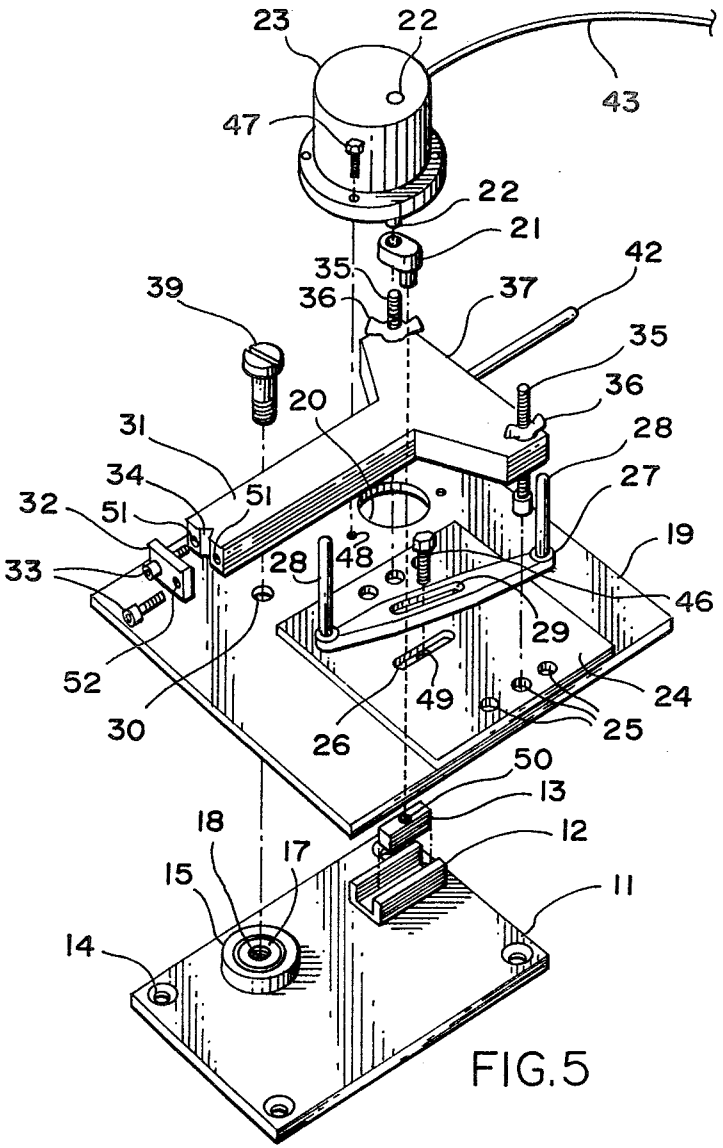
FIG. 5 is an exploded view of the device showing the component parts.
Figure 4:
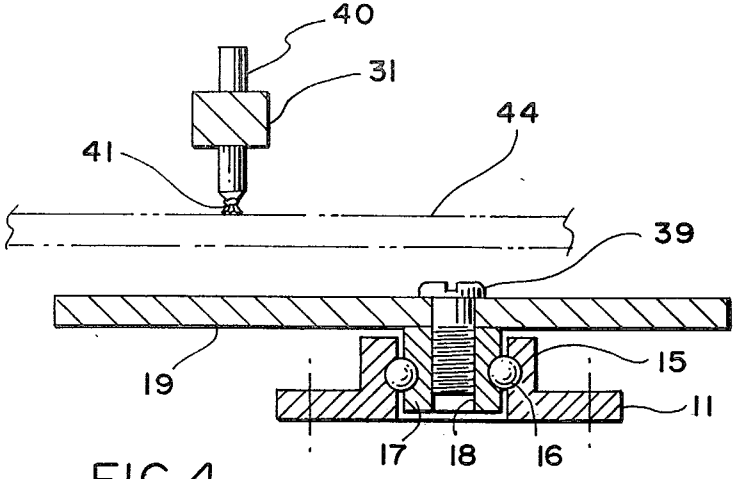
FIG. 4 is a sectional view showing the ball bearing pivotal structure and also showing the stone in contact with the lap plate.
Figure 3:
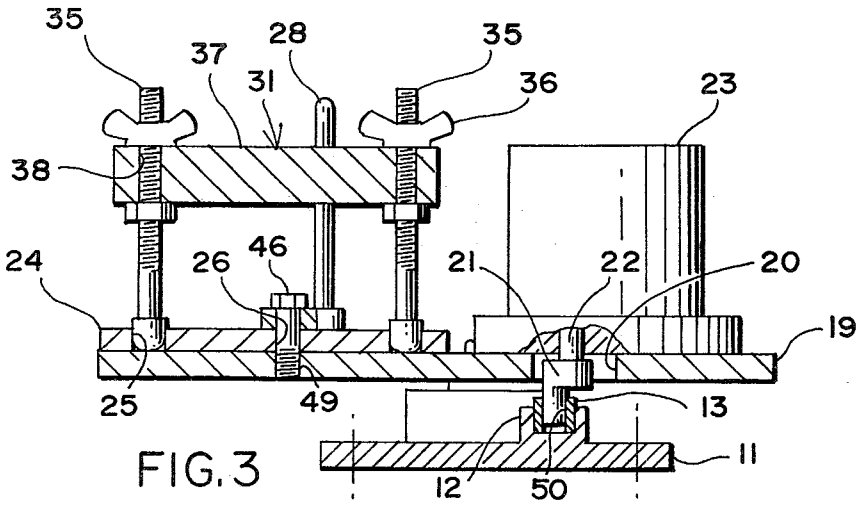
FIG. 3 is an end sectional view of the device showing details of the crank-slide.

Referring to the drawings by characters of reference, FIGS. 1–5 illustrate a pivotal work holding device 10.

The base 11 is fastened to a lapping bench by screws through the countersunk holes 14. The bearing housing 15 is mounted on the base 11 to contain the ball bearings

16 and the bearing race 17. The movable platform base 19 is secured to the bearing race 17 by the bolt 39 which extends through the hole 30 and into the hole 18 of the bearing race 17. The geared reduction motor 23 is mounted on the base 19 and secured in place by the bolts 47 extending into the threaded holes 48. The eccentric crank 21 is mounted on the motor shaft 22 and extends into the hole 50 in slide 13. The eccentric crank rotates within the confines of the hole 20 in the movable base 19. The slide 13 moves within the walls of the slide channel block 12 which is a part of the stationary base 11. Electric power is supplied to the motor 23 through the wire 43. The retaining plate 24 is mounted on the movable platform base 19 and held in place by the bolt 46 which extends through the support bracket 27 as well as the retaining plate 24 and into the threaded hole 49. The slot 26 in the retaining plate 24 allows movement of the retaining plate 24 on the surface of the movable base 19. The tong 31 is positioned on the retaining plate 24 with the legs 35 placed into the holes 25. The holes 25 allow for varied positions of the tong 31. The legs 35 are locked by the wingnuts 36. Extra rigidity is given to the tong 31 by the support bracket 27 by the support shafts 28 one of which bears against the side of the tong 31, the other bearing against the tail bar 42.

The dop 40 with the stone 41 is held in the groove 34 of the tong 31 and is secured by the clamp plate 32 and the screws 33. The stone 41 in the dop 40 is held against the surface of the lapping plate 44 for grinding. The tail bar 43 is secured in the rear surface 37 of the tong 31 and bears against the support shaft 28 of the support bracket 27. The support bracket 27 is movable by means of the slot 29. The legs 35 of the tong 31 are threaded and fit into threaded holes 38 for vertical adjustment. The dop holder 40 may be removed from the groove 34 by loosening the screws 33 which extend through the holes 52 in the plate 32 and into the threaded holes 51 in the end of tong 31. The device is mounted on the lapping bench 45 and several of the device may be used at the same time on the same lapping plate 44.

Although but a few embodiments of the invention have been shown and described, it will be apparent to those skilled in the art that various changes and modifications may be made therein without departing from the spirit of the invention or from the scope of the appended claims.

What is claimed is:

1. A work holding device for grinding gemstones and industrial diamonds comprising:

stationary base means for stationary mounting adjacent to a moving abrasive surface, movable base means pivotally mounted on said stationary base means for pivotal movement thereon, retaining means mounted on said movable base means for receiving and retaining dop holding means, said dop holding means having supporting structure extending downwardly to engage said retaining means and removably held by said retaining means said dop holding means holding a stone bearing dop in contact with an abrading surface, motive power means for powered movement of said movable base means and said dop holding means, eccentric crank and slide means connecting said motive power means and said movable base means to said stationary base means for transmitting powered movement to said movable base means, said movement causing said stone bearing dop to move across said abrading surface in a reciprocating arcuate path for the grinding of said stone.

2. Apparatus as set forth in claim 1 wherein said motive power means is a motor, gear reduced to low speed.

3. Apparatus as set forth in claim 1 wherein said dop holding means is a dop tong.

4. Apparatus as set forth in claim 3 wherein said dop tong has two legs extending downwardly for retention by said retaining means.

5. Apparatus as set forth in claim 1 wherein said retaining means is movably mounted on said movable base means so that the position of said retaining means may be varied.

* * * * *